United States Patent [19]

Nakamura et al.

[11] Patent Number: 4,946,823

[45] Date of Patent: Aug. 7, 1990

[54] HEAT-SENSITIVE RECORD MATERIAL

[75] Inventors: Mikio Nakamura, Nishinomiya; Yukio Takayama, Toyonaka, both of Japan

[73] Assignee: Kanzaki Paper Manufacturing Co., Ltd., Tokyo, Japan

[21] Appl. No.: 311,617

[22] Filed: Feb. 15, 1989

[30] Foreign Application Priority Data

Feb. 19, 1988 [JP] Japan ..... 63-38318
Sep. 22, 1988 [JP] Japan ..... 63-238124

[51] Int. Cl.[5] ..... B41M 5/18
[52] U.S. Cl. ..... 503/200; 427/150; 427/152; 503/207; 503/226
[58] Field of Search ..... 427/150–152; 428/913, 914; 503/200, 226, 207

[56] References Cited

U.S. PATENT DOCUMENTS 4,168,845 9/1979 Oeda et al. ..... 427/150

FOREIGN PATENT DOCUMENTS 2046138A 3/1989 United Kingdom ..... 427/150

*Primary Examiner*—Pamela R. Schwartz
*Attorney, Agent, or Firm*—Morgan & Finnegan

[57] ABSTRACT

In a heat-sensitive record material having a heat-sensitive recording layer on a base sheet, a middle layer is formed between the heat-sensitive recording layer and the base sheet by blade-coating on the base sheet a coating composition which mainly comprises at least one pigment having an oil absorption of at least 80 cc/100 g measured by JIS K 5101 and a binder and in which the binder ratio is 5% to 16% by weight of the total solid and the solid amount is 35 to 55% by weight of the coating composition.

8 Claims, No Drawings

HEAT-SENSITIVE RECORD MATERIAL

BACKGROUND OF THE INVENTION

This invention relates to a heat-sensitive record material and particularly to a heat-sensitive record material which is superior in record sensitivity and can develop color images having a good quality.

There has been well known heat-sensitive record materials utilizing the colorforming reaction between a basic colorless chromogenic material and an electron accepting acidic color developing material, in which color images are produced by heating to contact with each other of the basic colorless chromogenic material and the electron accepting acidic color developing material. The heat-sensitive recording materials are relatively cheep and the recording machine is compact and easy to maintain. Accordingly, they have been used in various fields as well as a record medium in facsimiles, computers and the like.

The recording speed becomes higher and resultantly requirements for the heat-sensitive record materials superior in dynamic record sensitivity have been increased. Further, the applied fields becomes wider. It is required for the heat-sensitive record material to develop color images having a good quality in any color density.

In order to satisfy the requirements, it has been proposed to form a middle layer between the base sheet and the recording layer. However, the required conditions such as coating method, coating composition and concentration of it have not yet been satisfactly studied, and a practical useful middle layer has not been obtained.

The object of the invention is to provide a heat-sensitive record materials having a very effective middle layer between the base sheet and the recording layer, which can develop color images superior in color density and having a good quality.

SUMMARY OF THE INVENTION

The heat-sensitive record materials according to the invention have a middle layer between the base sheet and the recording layer. The middle layer is formed by blade-coating a coating composition which mainly comprises at least one pigment having an oil absorption of at least 80 cc/100 g measured by JIS K 5101 and a binder, and in which the binder ratio is 5 to 16% by weight of the total solids and the solid amount is 35 to 55% by weight of the coating composition.

DETAILED DESCRIPTION OF THE INVENTION

In the heat-sensitive record materials according to the invention, a middle layer is formed between the base sheet and the recording layer, preferably in contact with the recording layer, by blade-coating a coating composition mainly comprising a specific oil absorbing pigment and a binder in a specific binder ratio and a specific solid amount.

As the pigments having an oil absorption of at least 80 cc/100 g measured by JIS K 5101, there are exemplified pigments having the above specific oil absorption, such as calcined clay, aluminum oxide, titanium oxide, magnesium carbonate, diatomaceous earth, amorphous silica, aluminum silicate, magnesium silicate, calcium silicate, sodium alminosilicate, magnesium alminosilicate and the like; and modified pigments which are obtained by physically or chemically treating general organic or inorganic pigments to have the above specific oil absorption. These pigments are superior in heat insulation so that they can effectively improve the record sensitivity of heat-sensitive record materials comprising them in the middle layer. The most preferable pigments are calcined clay and amorphous silica.

The oil absorption value is defined in JIS (Japan Industrial Standard) K 5101 as follows:

1 to 5 gm. of a sample is weighed and put on a glass plate (about 250×250×5 mm). Then linseed oil is added dropwise to the center of the sample from a burette and simultaneously is mixed by a spatula.

This adding and mixing process is repeated until the mixture becomes a putty-like solid.

The used amount of linseed oil is measured and the oil absorption value is calculated by:

$$G=, (H/S)\times 100$$

where H is the linseed oil amount (ml), S is the initial sample weight (gm).

The specific oil absorbing pigments may be used together with general pigments having an oil absorption of less than 80 cc/100 g and/or various additives. However, it is preferred to use the pigments having an oil absorption of at least 80 cc/100 g in an amount of 60~95% by weight on the basis of the total solid amount of the middle layer. Among the oil absorbing pigments used in the middle layer, there are included organic pigments having such large oil absorption as about 1100 cc/100 g, but since the pigments having too large oil absorption tend to make the coating composition comprising them inferior in fluidity, the pigments having an oil absorption of 80~800 cc/100 g, particularly 80~600 cc/100 g, are preferably used.

Among the binders used with the pigments, there are exemplified water soluble polymers such as starch, casein, polyvinyl alcohols, methyl-cellulose, carboxymethylcellulose, hydroxyethylcellulose, polyacrylic acid and the like; and various synthetic resin emulsions, such as styrene-butadiene copolymer emulsions, styrene-acrylic acid copolymer emulsions, acrylonitrile-butadiene copolymer emulsions, emulsions of styrene-acryl ester copolymer complexed with colloidal silica, acryl acid copolymer emulsions and the like.

The method for preparing the middle layer coating composition is not perticularly limited. For example, it may be prepared by dispersing pigments in water with an agitator and then adding a binder in the aqueous dispersion.

The middle layer coating composition mainly containing a specific oil absorbing pigment and a binder should be prepared to have a binder ratio of 5 to 16% by weight, preferably 7 to 13% by weight, on the basis of the total solid amount to obtain a superior blade coating applicability, a desired record sensitivity of the produced heat-sensitive record materials and a desired adhesion. If the binder ratio is more than 16% by weight, voids of the obtained middle layer are reduced to lower the heat insulation so that a desired record sensitivity can not be obtained and a smudge adhesion on the thermal head is increased. On the contrary, if the binder ratio is less than 5% by weight, the adhesion force of pigment particles is lowered so that the troubles such as production of paper powder by cutting the record materials, peeling of the recording layer by folding the record materials and the like are occurred.

The middle layer according to the invention is formed by blade-coating on a base sheet the coating composition as described above. When applied by blade-coating, the solid amount of the coating composition is an important feature. As described hereinbefore, the coating composition having a solid amount of 35 to 55% by weight should be used, and that having a solid amount of 40 to 52% by weight is more preferably used. If the solid amount is less than 35% by weight, it is difficult to coat the coating composition in a sufficient amount or it is difficult to form a smooth coated layer so that it is impossible to make use of the desired characteristics of blade-coating. On the contrary, if the solid amount is more than 55% by weight, fluidity of the coating composition under a high share force is reduced owing to oil absorbing pigments comprised in a relatively large amount and resultantly troubles such as streaks, scratches, stalactites and the like are easily occured by blade-coating.

Among the blade-coating methods applied in the invention, there may be included not only methods using a Bevel type blade or a Bent type blade but also methods using a Rod blade or a Billblade. The middle layer of the invention, produced by blade-coating on a base sheet such specific coating composition as defined in the above, has a very smooth surface different from that produced by air-knife coating and the like. Accordingly, it is not necessary to apply an excessive calender treatment and the like, and voids in the middle layer maintain in a high ratio. Resultantly the application of blade-coating contributes to form heat-sensitive record materials which can produce color images having a high quality in a high sensitivity. Further, the drying speed of the coating layer is very high so that the required equipments and energies are remarkably reduced.

Among various blade coaters, a "short-dwell-time-coater" in which the time required after applying an excessive coating composition on a base sheet to cut off the excess amount of it (hereinafter referred to as "Dwelltime") is as low as 0.015 seconds or less is preferably used. The most preferably Dwelltime is 0.013 seconds or less.

Since the pigments having a high oil absorption as used in the invention to form a middle layer have a high bulkiness, they show a tendency to reduce water retention of the coating composition produced with the use of them in comparison with general pigments. Accordingly, with the use of a coater having a relatively long Dwelltime, the coating composition is condensed until cutting off the excess amount of it so that troubles such as streaks, stalactites and the like easily occur. Resultantly, applying a short-dwell-time-coater in which the Dwelltime is short is very useful to form a middle layer according to the invention. A short-dwell-time-coating can be attained by adjusting the distance between applicator means for applying the coating composition on a base sheet and blade means for cutting off the excess coating composition to about 0~16 cm. In Billblade coater the distance between applicator means and blade means may be adjusted to 0 cm, but generally in the other short-dwell-time-coaters it is preferred to adjust the distance to 3 to 11 cm.

The coating amount of the middle layer is not particularly limited. It is preferably selected within the range of 1 to 30 g/m$^2$ on dry basis depending on the desired properties of heat-sensitive record materials. The middle layer may be formed in the form of multi-layers, but it is preferred to prepare it in the form of less than four layers because of the workability.

The blade-coating of the coating composition may be applied with either off machine coater or on machine coater set on a paper making machine. Particularly, when wood free paper is used as a base sheet, on machine coators are preferably used, because a sufficient coated amount is easily obtained due to the effects of the paper temperature immediately before coating and the drying property is good.

Heat-sensitive record materials according to the invention are obtained by forming a heat-sensitive recording layer on thus obtained middle layer. The combination of color forming materials and color developing materials, which are comprised in the recording layer, is not particularly limited. Any combination can be used so far as color images are produced by heating to contact with each other of the color forming material and the color developing material. For example, there may be exemplified a combination of colorless or pale colored basic chromogenic materials and inorganic or organic acidic compounds, a combination of metal salts of higher fatty acids such as ferric stearate and phenols such as gallic acid, and a combination of diazonium compounds, coupling agents and basic compounds. Among them, the combination of colorless or pale colored basic chromogenic materials and inorganic or organic acidic compounds is very useful to obtain the desired advantages of the invention and accordingly most preferably used.

Among the colorless or pale colored chromogenic materials comprised in the record layer according to the present invention, there are exemplified triarylmethane compounds such as 3,3-bis(p-dimethylaminophenyl)-6-dimethylaminophthalide, 3,3-bis(p-dimethylaminophenyl)phthalide, 3-(p-dimethylaminophenyl)-3-(1,2-dimethylindole-3-yl)phthalide, 3-(p-dimethylaminophenyl)-3-(2-methylindole-3-yl)phthalide, 3,3-bis(1,2-dimethylindole-3-yl)-5-dimethylaminophthalide, 3,3-bis(1,2-dimethylindole-3-yl)-6-dimethylaminophthalide, 3,3-bis(9-ethylcarbazole-3-yl)-6-dimethylaminophthalide, 3,3-bis(2-phenylindole-3-yl)-6-dimethylaminophthalide, 3-p-dimethylaminophenyl-3-(1-methylpyrrole-3-yl)-6-dimethylaminophthalide and the like; diphenylmethane compounds such as 4,4'-bis-dimethylaminobenzhydryl benzyl ether, N-halophenylleucoauramine, N-2,4,5-trichlorophenyl-leucoauramine and the like; thiazine compounds such as benzoylleucomethylene blue, p-nitrobenzoyl-leucomethylene blue and the like; spiro compounds such as 3-methylspiro-dinaphthopyran, 3-ethyl-spiro-dinaphthopyran, 3-phenyl-spiro-dinaphthopyran, 3-benzyl-spiro-dinaphthopyran, 3-methyl-naphtho-(6'-methoxybenzo)spiropyran, 3-propyl-spiro-dibenzopyran and the like; lactam compounds such as Rhodamine-B anilinolactam, Rhodamine(p-nitroanilino)lactam, Rhodamine(o-chloroanilino)lactam and the like; and fluoran compounds such as 3-dimethylamino-7-methoxyfluoran, 3-diethylamino-6-methoxyfluoran, 3-diethylamino-7-methoxyfluoran, 3-diethylamino-7-chlorofluoran, 3-diethylamino-6-methyl-7-chlorofluoran, 3-diethylamino-6,7-dimethylfluoran, 3-(N-ethyl-p-toluidino)-7-methylfluoran, 3-diethylamino-7-(N-acetyl-N-methylamino)-fluoran, 3-diethylamino-7-N-methylaminofluoran, 3-diethylamino-7-dibenzylaminofluoran, 3-diethylamino-7-(N-methyl-N-benzylamino)fluoran, 3-diethylamino-7-(N-chloroethyl-N-methylamino)fluoran, 3-diethylamino-7-N-diethylaminofluoran, 3-(N-ethyl-p-toluidino)-6-methyl-7-phenylaminofluoran, 3-(N-cyclopentyl-N-ethylamino)-6-methyl-7-anilinofluoran, 3-(N-ethyl-p-toluidino)-6-methyl-7-(p-toluidino)fluoran, 3-diethylamino-6-methyl-7-phenylaminofluoran, 3-diethylamino-7-(2-carbomethoxy-phenylamino)fluoran, 3-(N-ethyl-N-isoamylamino)-6-methyl-7-phenylaminofluoran, 3-(N-cyclohexyl-N-methylamino)-6-methyl-7-phenylaminofluoran, 3-pyrrolidino-6-methyl-7-phenylaminofluoran, 3-piperidino-6-methyl-7-phenylaminofluoran, 3-diethylamino-6-methyl-7-xylidinofluoran, 3-diethylamino-7-(o-chlorophenylamino)fluoran, 3-dibutylamino-7-(o-chlorophenylamino)fluoran, 3-pyrrolidino-6-methyl-7-p-butylphenylaminofluoran, 3-N-methyl-N-tetrahydrofurfurylamino-6-methyl-7-anilinofluoran, 3-N-ethyl-N-tetrahydrofurfurylamino-6-methyl-7-anilinofluoran, and the like. These chromogenic materials may be used either solely or in combination.

Among the acidic compounds which develop a color by contacting with the above chromogenic materials, there are included inorganic acidic compounds such as activated clay, acid clay, attapulgite, bentonite, colloidal silica, aluminum silicate and the like; organic acidic compounds such as phenolic compounds, e.g., 4-tert-butylphenol, 4-hydroxydiphenoxide, α-naphthol, β-naphthol, 4-hydroxyacetophenol, 4-tert-octylcatechol, 2,2'-hydroxydiphenol, 2,2'-methylenebis(4-methyl-6-tert-butylphenol), 4,4'-isopropylidenebis(2-tert-butylphenol), 4,4'-sec-butylidenediphenol, 4-phenylphenol, 4,4'-isopropylidenediphenol (bisphenol A), 2,2'-methylenebis(4-chlorophenol), hydroquinone, 4,4'-cyclohexylidenediphenol, benzyl 4-hydroxybenzoate, dimethyl 4-hydroxyphthalate, hydroquinone monobenzyl ether, novolak phenol resin, phenol polymers and the like; aromatic carboxylic acids, e.g., benzoic acid, p-tert-butylbenzoic acid, trichlorobenzoic acid, terephthalic acid, 3-sec-butyl-4-hydroxybenzoic acid, 3-cyclohexyl-4-hydroxybenzoic acid, 3,5-dimethyl-4-hydroxybenzoic acid, salicylic acid, 3-isopropylsalicylic acid, 3-tert-butylsalicylic acid, 3-benzylsalicylic acid, 3-(α-methylbenzyl)salicylic acid, 3-chloro-5-(α-methylbenzyl)salicylic acid, 3,5-di-tert-butylsalicylic acid, 3-phenyl-5-(α,α-dimethylbenzyl)salicylic acid, 3,5-di-α-methylbenzylsalicylic acid and the like; and salts of the above phenolic compounds or aromatic carboxylic acids with polyvalent metals such as zinc, magnesium, aluminum, calcium, titanium, manganese, tin and nickel. These acidic compounds may be used either solely or in combination.

The ratio of the color forming materials and the color developing materials used in the present invention may be suitably selected depending on the kind of the color forming material and the color developing material, accordingly is not particularly limited. However, when basic chromogenic materials and acidic compounds are used, the amount of the acidic compounds is generally within the range of 1 to 50 parts by weight, preferably within the range of 1 to 10 parts by weight, per one part by weight of the chromogenic materials.

The method for forming the recording layer is not limited. It is formed by applying a coating composition on a base sheet having a middle layer. The coating composition may be prepared by dispersing, simultaniously or separately, the color forming material and the color developing material in an aqueous medium with the use of a mixer or pulverizer such as ball mill, attritor, sand mill or the like.

The coating composition usually may comprise a binder in an amount of 10 to 70%, preferably 15 to 50% by weight on the basis of total solid amount. Among the useful binder materials there may be included starches, hydroxyethylcellulose, methylcellulose, carboxymethyl cellulose, gelatin, casein, gum arabic, polyvinyl alcohol, salts of diisobutylene-maleic anhydride copolymer, salts of styrene-maleic anhydride copolymer, salts of ethylene-acrylic acid copolymer, salts of styrene-acrylic acid copolymer, natural rubber emulsions, styrene-butadiene copolymer emulsions, acrylonitrile-butadiene copolymer emulsions, methyl methacrylate-butadiene copolymer emulsions, polychloroprene emulsions, polyvinyl acetate emulsions, ethylene-vinyl acetate copolymer emulsions and the like.

The coating composition may include additives such as dispersing agents, e.g., sodium dioctylsulfosuccinate, sodium dodecylbenzenesulfonate, sodium lauryl sulfate, alginates and metal salts of fatty acids; ultraviolet ray absorber, e.g., benzophenone compounds and triazole compounds; antifoaming agent; fluorescent dyes; coloring dyes and the like.

Further, in the coating composition, there may be added lubricants such as zinc stearate, calcium stearate, polyethylene wax, carnauba wax, paraffin wax and ester wax; inorganic pigments such as calcium carbonate, zinc oxide, aluminum oxide, titanium dioxide, silicon dioxide, aluminum hydroxide, barium sulfate, zinc sulfate, talc, kaolin, clay, calcined clay, coloidal silica and the like; organic pigments such as styrene microballs, Nylon powder, polyethylene powder, urea-formaldehyde resin filler, raw starch and the like; fatty acid amides such as stearic acid amide, methylenebis stearic acid amide, oleic acid amide, palmitic acid amide, coconut aliphatic acid, amide and the like; hindered phenols such as dibenzyl terephthalate, 1,2-di(3-methylphenoxy)ethane, 1,2-diphenoxyethane, diphenylmethyl 4,4'-ethylenedioxy-bis-benzoate, 1,1,3-tris(2-methyl-4-hydroxy-5-tert-butylphenyl)butan, 2,2'-methylenebis(4-methyl-6-tert-butylphenol), 4,4'-butylidenebis(6-tert-butyl-3-methylphenol) and the like; and various known heat-fusible materials.

When an inorganic or organic pigment is contained in the coating composition to form the recording layer, it is preferable to use pigments having a diameter as small as possible, the most preferably to use pigments having a diameter of 2 μm or less.

In order to form the recording layer according to the invention, there may be applied any conventional coating technique. For example, a coating composition is coated on the middle layer with an air-knife coator, a blade coator or the like, and then dried. The amount of the applied coating composition is generally within 2 to 12 g/m$^2$, preferably 3 to 10 g/m$^2$ on dry basis.

The base sheet used in the invention is not also limited. Among the base sheets, there are included papers such as wood free paper, base paper made by Yankee machine, single-faced machine grazed paper, double-faced machine grazed paper, cast-coated paper, art paper, coated paper, light weight coated paper and the like; synthetic fiber paper; synthetic resin films and the like.

The heat-sensitive record materials, if necessary, may be smoothed after forming a middle layer and/or a recording layer by super-calendering or the like. Further, an over-coating layer may be applied on it to protect the recording layer. Various known additional techniques in the process for producing heat-sensitive record materials, such as forming a back coating on the base sheet and the like, may be applicable.

Since thus obtained heat-sensitive record materials according to the present invention have a middle layer consisting of a specific composition and applied by a spcific manner between the base sheet and the heat-sensitive recording layer, they are superior in record sensitivity and can develop good color images superior in color density and image quality.

PREFERRED EMBODIMENTS OF THE INVENTION

The following examples serve to illustrate the invention in more detail although the invention is not limited to the examples. Unless otherwise indicated, parts and % signify parts by weight and % by weight, respectively.

EXAMPLE 1

(1) Formation of a middle layer on a base sheet:

The following composition was mixed to prepare a coating composition (I) having a binder ratio of 11.6% and a solid amount of 43%.

| | |
|---|---|
| calcined clay (Ansilex manufactured by Engelhard Minerals & Chemicals Corporation, oil absorption: 110 cc/100 g) | 100 parts |
| styrene-butadiene copolymer latex (Dow-1571 manufactured by Asahi Kasei Kabushiki Kaisha, solid amount: 48%) | 17 parts |
| 25% aqueous solution of oxidized starch | 20 parts |
| water | 126 parts |

The coating composition (I) was coated on wood free paper of 50 g/m$^2$ in a paper-making machine by a Bevel blade coater with a Dwelltime of 0.05 seconds in the weight of an amount of 7 g/m$^2$ on dry basis and dried to obtain a base sheet having a middle layer.

(2) Preparation of dispersion A:

The following composition was pulverized by a sand mill.

| | |
|---|---|
| 3-(N-cyclohexyl-N-methylamino)-6-methyl-7-phenylaminofluoran | 10 parts |
| 1,2-bis-(3-methylphenoxy)ethane | 15 parts |
| 5% aqueous solution of methylcellulose | 15 parts |
| water | 80 parts |

Pulverization was continued until an average particle size of 3 μm.

(3) Preparation of dispersion B:

The following composition was pulverized by a sand mill.

| | |
|---|---|
| 4,4'-isopropylidenediphenol | 30 parts |
| 5% aqueous solution of methylcellulose | 30 parts |
| water | 70 parts |

Pulverization was continued until an average particle size of 3 μm.

(4) Making a heat-sensitive record material:

The following composition was mixed to prepare a coating composition.

| | |
|---|---|
| dispersion A | 120 parts |
| dispersion B | 130 parts |
| amorphous silica | 30 parts |
| 20% aqueous solution of oxidized starch | 150 parts |
| water | 55 parts |

The coating composition was coated on the middle layer of the above base sheet in the weight of an amount of 5 g/m$^2$ on dry basis, dried and super-calendered to obtain a heat-sensitive record material.

EXAMPLE 2

The following composition was mixed to prepare a coating composition (II) having a binder ratio of 11.6% and a solid amount of 46%.

| | |
|---|---|
| calcined clay (Ansilex manufactured by Engelhard Minerals & Chemicals Corporation, oil absorption: 110 cc/100 g) | 95 parts |
| magnesium carbonate (oil absorption 150 cc/100 g) | 5 parts |
| styrene-butadiene copolymer latex (Dow-1571 manufactured by Asahi Kasei Kabushiki Kaisha, solid amount: 48%) | 17 parts |
| 25% aqueous solution of oxidized starch | 20 parts |
| water | 109 parts |

A heat-sensitive record material was obtained in the same manner as in Example 1 except that the above coating composition (II) was used instead of the coating composition (I) to form the middle layer.

EXAMPLE 3

The following composition was mixed to prepare a coating composition (III) having a binder ratio of 8.4% and a solid amount of 50%.

| | |
|---|---|
| amorphous silica (oil absorption 200 cc/100 g) | 70 parts |
| calcium carbonate (oil absorption 43 cc/100 g) | 30 parts |
| styrene-butadiene copolymer latex (Dow-1571 manufactured by Asahi Kasei Kabushiki Kaisha, solid amount: 48%) | 17 parts |
| 2% aqueous solution of carboxymethylcellulose | 50 parts |
| water | 51 parts |

A heat-sensitive record material was obtained in the same manner as in Example 1 except that the above coating composition (III) was used instead of the coating composition (I) to form the middle layer

EXAMPLE 4

A heat-sensitive record material was obtained in the same manner as in Example 1 except that a short-dwell-time-coater (Dwelltime: 0.002 sec.) was used as a blade coater to prepare the middle layer.

EXAMPLE 5

A heat-sensitive record material was obtained in the same manner as in Example 1 except that a Billblade coater was used as a blade coater to prepare the middle layer.

COMPARATIVE EXAMPLE 1

A heat-sensitive record material was obtained in the same manner as in Example 1 except that a coating composition having a binder ratio of 11.6% and a solid amount of 23% which was prepared by diluting the coating composition (I) with water was coated on wood free paper of 50 g/m$^2$ by an air-knife coater in the weight of an amount of 7 g/m$^2$ on dry basis and dried to prepare the middle layer.

COMPARATIVE EXAMPLE 2

The following composition was mixed to prepare a coating composition (IV) having a binder ratio of 3.7% and a solid amount of 43%.

| | |
|---|---|
| calcined clay (Ansilex manufactured by Engelhard Minerals & Chemicals Corporation, oil absorption: 110 cc/100 g) | 100 parts |
| styrene-butadiene copolymer latex (Dow-1571 manufacturd by Asahi Kasei Kabushiki Kaisha, solid amount: 48%) | 8 parts |
| water | 133 parts |

A heat-sensitive record material was obtained in the same manner as in Example 1 except that the coating composition (IV) was used instead of the coating composition (I) to prepare the middle layer.

COMPARATIVE EXAMPLE 3

The following composition was mixed to prepare a coating composition (V) having a binder ratio of 19.4% and a solid amount of 46%.

| | |
|---|---|
| calcined clay (Ansilex manufactured by Engelhard Minerals & Chemicals Corporation, oil absorption: 110 cc/100 g) | 100 parts |
| styrene-butadiene copolymer latex (Dow-1571 manufactured by Asahi Kasei, Kabushiki Kaisha, solid amount: 48%) | 50 parts |
| water | 119 parts |

A heat-sensitive record material was obtained in the same manner as in Example 1 except that the coating composition (V) was used instead of the coating composition (I) to prepare the middle layer.

COMPARATIVE EXAMPLE 4

The following composition was mixed to prepare a coating composition (VI) having a binder ratio of 11.6% and a solid amount of 53%.

| | |
|---|---|
| kaolin (UW-90 manufactured by Engelhard Minerals & Chemicals Corporation, oil absorption: 35 cc/100 g) | 100 parts |
| styrene-butadiene copolymer latex (Dow-1571 manufactured by Asahi Kasei Kabushiki Kaisha, solid amount: 48%) | 17 parts |
| 25% aqueous solution of oxidized starch | 20 parts |
| water | 77 parts |

A heat-sensitive record material was obtained in the same manner as in Example 1 except that the coating composition (VI) was used instead of the coating composition (I) to prepare the middle layer.

COMPARATIVE EXAMPLE 5

A coating composition having a binder ratio of 8.4% and a solid amount of 58% was prepared in the same manner as in the preparation of the coating composition (III) in Example 3 except that the water amount was decreased from 51 parts to 21 parts. The coating composition was blade-coated in the same manner as in Example 3. However, the coating applicability was very bad to produce numerous streaks and stalactites and resultantly a middle layer can not be obtained.

The properties of the record material obtained in each of Examples and Comparative examples were examined. The results are shown in Table 1.

1. Coating applicability:

The coating applicability when the middle layer was formed on a base sheet was evaluated with the state of generation of troubles such as streaks, scratchs, stalactites and the like.

A. . . . . There is not generated any streak, scratch, staractite or the like.

B. . . . . There are scarcely generated streaks, scratches, staractites and the like.

D. . . . . There are generated too many streaks, scratches, staractites and the like to obtain a coated layer.

2. Initial color density:

Each record material was recorded by a facsimile (FF-1500 RS manufactured by Fujutsu Limited) to develop a color image. The optical density of the color image was measured by Macbeth densitometer RD-100R manufactured by Macbeth Corp.

3. Quality of images:

The quality of images was examined by visual observation.

A. . . . . It is good

C. . . . . It is bad.

D. . . . . It is too bad for practical use.

4. Cutting operability:

Each of the recorded portion and unrecorded portion of the recod material was cut with a cutter, and the cutting operability was evaluated as follows.

A. . . . . There is neither generation of paper powder nor peeling of the recording layer.

D. . . . . Paper powder is generated and the recording layer was peeled.

| | Coating applicability | Initial color density | quality of images | cutting operability |
|---|---|---|---|---|
| Example | | | | |
| 1 | B | 1.35 | A | A |
| 2 | B | 1.33 | A | A |
| 3 | B | 1.34 | A | A |
| 4 | A | 1.35 | A | A |
| 5 | B | 1.34 | A | A |
| Comparative example | | | | |
| 1 | B | 1.22 | C | A |
| 2 | B | 1.37 | A | D |
| 3 | B | 1.23 | C | A |
| 4 | B | 1.15 | D | A |
| 5 | D | — | — | — |

As shown in Table 1, the record materials obtained in Examples according to the invention can develop color images having a good quality and a superior color density and further they are superior in the cutting operability after recording.

What we are claimed:

1. A heat-sensitive record material comprising a middle layer between a heat-sensitive recording layer and a base sheet, characterized in that said middle layer is formed by blade-coating a coating composition on said base sheet, said coating composition comprising at least one oil absorbing pigment having an oil absorption of at least 80 cc/100 g measured by JIS K 5101 and a binder having a binder ratio of 5 to 16% by weight of the total said coating composition having a solids amount of 35 to 55% by weight.

2. A heat-sensitive record material as defined in claim 1, wherein said oil absorbing pigment is calcinated clay or amorphous silica.

3. A heat-sensitive record material as defined in claim 1, wherein said middle layer is formed by blade-coating consisting of coating with an excessive amount of said coating composition, and then cutting off the excess amount of said coating composition with a blade within 0.015 seconds after applying said coating composition.

4. A heat-sensitive record material as defined by claim 3, wherein said blade-coating is carried out with a Bevel type blade, a Bent type blade, a Rod blade or a Billblade.

5. A heat-sensitive record material as defined by claim 1, wherein said middle layer is formed by blade-coating using said coating composition one or more times to obtain a coated layer having a total amount of 1 to 30 g/m$^2$ on a dry basis of said coating composition.

6. A heat-sensitive record material as defined in claim 1, wherein said middle layer comprises said oil absorbing pigment in an amount of 60 to 95% by weight on a dry basis.

7. A heat-sensitive record material as defined by claim 1, wherein said oil absorbing pigment has an oil absorption of 80 cc/100 g to 1100 cc/100 g measured by the JIS K 5101 test.

8. A method for producing a heat-sensitive record material comprising a middle layer between the heat-sensitive recording layer and the base sheet, said middle layer is blade-coated on a base sheet using a coating composition; said coating composition contains at least one oil absorbing pigment which has an oil absorption of at least 80 cc/100 g measured by JIS K 5101; said coating composition has a binder ratio of 5 to 16% by weight of total solids; and said coating composition has a solid amount of 35 to 55% by weight of said coating composition.

* * * * *